US010350900B2

(12) United States Patent
Sun et al.

(10) Patent No.: US 10,350,900 B2
(45) Date of Patent: Jul. 16, 2019

(54) TYPE OF IMAGING CARTRIDGE CHIPS AND METHODS FOR RESPONDING TO READ/WRITE CONSUMABLE VOLUME INFORMATION IN AN IMAGING DEVICE

(71) Applicant: APEX MICROELECTRONICS CO., LTD., Zhuhai, Guangdong (CN)

(72) Inventors: Xuejin Sun, Guangdong (CN); Linlin Zhang, Guangdong (CN); Chaoai Deng, Guangdong (CN)

(73) Assignee: APEX MICROELECTRONICS CO., LTD., Zhuhai (CN)

( * ) Notice: Subject to any disclaimer, the term of this patent is extended or adjusted under 35 U.S.C. 154(b) by 3 days.

(21) Appl. No.: 15/651,028

(22) Filed: Jul. 17, 2017

(65) Prior Publication Data

US 2017/0320327 A1 Nov. 9, 2017

Related U.S. Application Data

(63) Continuation of application No. PCT/CN2016/070474, filed on Jan. 8, 2016.

(30) Foreign Application Priority Data

Jan. 20, 2015 (CN) ..... 2015 1 0028225

(51) Int. Cl.
*B41J 2/175* (2006.01)

(52) U.S. Cl.
CPC ..... *B41J 2/1753* (2013.01); *B41J 2/175* (2013.01); *B41J 2/17506* (2013.01); (Continued)

(58) Field of Classification Search
CPC ..... B41J 2/17566; B41J 2002/17589
See application file for complete search history.

(56) References Cited

U.S. PATENT DOCUMENTS 6,761,427 B1 * 7/2004 Owen ..... B41J 2/17566 347/19
7,444,864 B2 11/2008 Yajima et al.
(Continued)

FOREIGN PATENT DOCUMENTS

CN 101049762 A 10/2007
CN 102147587 A 8/2011
(Continued)

OTHER PUBLICATIONS

International Search Report in PCT /CN2016/070474 dated Apr. 21, 2016, 2 pages.
(Continued)

*Primary Examiner* — Julian D Huffman
(74) *Attorney, Agent, or Firm* — Metis IP LLC

(57) ABSTRACT

A method for responding to read/write consumable volume information in an imaging device. The method includes: receiving first consumable volume information from the imaging device and storing the received first consumable volume information; receiving second consumable volume information from the imaging device; obtaining, by the imaging cartridge chip, the first consumable volume information and transmitting the first consumable volume information to the imaging device when the imaging device requests reading consumable volume information stored in the imaging cartridge chip for determining a remaining consumable volume in an cartridge; obtaining, by the cartridge chip, the second consumable volume information and transmitting the second consumable volume information to the imaging device when the imaging device requests reading consumable volume information stored in the imaging cartridge chip to indicate the remaining consumable volume in the cartridge, the second consumable volume information
(Continued)

being less accurate than the first consumable volume information.

15 Claims, 6 Drawing Sheets

(52) U.S. Cl.
CPC ..... *B41J 2/17546* (2013.01); *B41J 2/17566* (2013.01); *B41J 2002/17573* (2013.01); *B41J 2002/17589* (2013.01)

(56) References Cited

U.S. PATENT DOCUMENTS

| | | | |
|---|---|---|---|
| 7,578,567 | B2 | 8/2009 | Zhang et al. |
| 7,866,801 | B2 | 1/2011 | Ishizawa et al. |

FOREIGN PATENT DOCUMENTS

| | | | |
|---|---|---|---|
| CN | 102941736 | A | 2/2013 |
| CN | 203324652 | U | 12/2013 |
| CN | 104125358 | A | 10/2014 |
| CN | 104260565 | A | 1/2015 |

OTHER PUBLICATIONS

First office action for Chinese application No. 201510028225.2 dated Oct. 26, 2017, 11 pages.

* cited by examiner

| Remaining Consumable Volume | Second Consumable Volume Information |
|---|---|
| 100% | 0000 |
| ⋮ | |
| 87.5% | 0001 |
| ⋮ | |
| 75% | 0010 |
| ⋮ | |
| 62.5% | 0100 |
| ⋮ | |
| 50% | 0101 |
| ⋮ | |
| 37.5% | 1101 |
| ⋮ | |
| 25% | 1000 |
| ⋮ | |
| 12.5% | 1001 |
| ⋮ | |
| 0 | 0011 |

FIG. 5

| | Second Consumable Volume Information | Data Flag Bit |
|---|---|---|
| a1 | 0000 | 0 |
| a2 | 0001 | 0 |
| a3 | 0010 | 0 |
| a4 | 0101 | 0 |
| | ⋮ | ⋮ |
| aN | 0011 | 0 |

0010 b

FIG. 6

| | State Of Second Consumable Volume Information | Data Flag Bit |
|---|---|---|
| a1 | 0000 | 0 |
| a2 | 0001 | 0 |
| a3 | 0010 | 1 |
| a4 | 0101 | 0 |
| | ⋮ | ⋮ |
| aN | 0011 | 0 |

FIG. 7

| First Consumable Volume Information | Second Consumable Volume Information |
|---|---|
| ⋮ | ⋮ |
| ⋮ | 1101 |
| 10010000 | |
| 10010001 | |
| ⋮ | |
| ⋮ | 1001 |
| 10011001 | |
| 10011111 | |
| ⋮ | |
| ⋮ | ⋮ |

FIG. 8

TYPE OF IMAGING CARTRIDGE CHIPS AND METHODS FOR RESPONDING TO READ/WRITE CONSUMABLE VOLUME INFORMATION IN AN IMAGING DEVICE

CROSS-REFERENCE TO RELATED APPLICATIONS

This application is a continuation of International Application No. PCT/CN2016/070474, filed on Jan. 8, 2016, which claims the priority of Chinese Application No. 201510028225.2, filed on Jan. 20, 2015 and entitled "Imaging cartridge chip and method for responding to read/write consumable volume information in an imaging device," the content of which is hereby incorporated by reference to its entirety.

TECHNICAL FIELD

The present disclosure relates to the field of imaging technologies, specifically, to imaging cartridge chips and methods for responding to read/write consumable volume information in an imaging device.

BACKGROUND

As imaging technologies develop, imaging devices such as copiers, printers, fax machines, and word processors are widely used. Such imaging devices include an imaging cartridge for containing ink or toner (both hereinafter referred to as consumable), which is convenient for a user to replace. Usually, an unused imaging cartridge may store a certain volume of consumable. When the consumable in the imaging cartridge is exhausted, it is necessary to replace the imaging cartridge in time.

In order to remind the user of replacing the imaging cartridge in time and avoiding degradation of the imaging quality and damages to the imaging device caused by the continuous printing after the consumable is exhausted, more and more imaging cartridges are equipped with imaging cartridge chips. The imaging device may determine consumable volume information (mainly indicated by remaining consumable volume information or consumable consumption information) in the imaging cartridge and store the consumable volume information in the chip.

During an imaging operation, the imaging device reads the consumable volume information from the chip and displays the consumable volume information to the user in a relatively intuitive way, for example, in the form of a percentage or a progress bar, so as to allow the user to know currently remaining consumable volume in the imaging cartridge and remind the user of replacing imaging cartridge in time when the remaining consumable volume in the imaging cartridge is relatively few. When the consumable in the imaging cartridge is about to be exhausted, the imaging device may "lock" the chip to prevent the imaging device from continuing imaging operation, avoiding degradation of the imaging quality that may lead to the waste of paper and consumable, and also avoiding damages to the imaging device when the consumable is insufficient.

In order to accurately predict when the imaging cartridge needs to be replaced, the consumable volume information should have a high accuracy to ensure effectively that the imaging cartridge does not contain a relatively large volume of remaining consumable and avoid waste of consumable when the imaging device "locks" the chip. From the perspective of using consumable economically and reducing costs as much as possible, the user usually purchases a new imaging cartridge for replacement only when the user discovers, by observing the percentage or the progress bar of the imaging device, that the consumable in the imaging cartridge is nearly exhausted.

Some of the existing imaging devices may be compatible with multiple types of imaging cartridges. Different types of imaging cartridges may differ greatly in the number of pages that can be imaged. If the remaining consumable volume is reminded using the same standard, it is easy for the user to make a misjudgment on the number of printable pages when the accuracy of the consumable volume information is too high.

For example, an imaging device may indicate a remaining consumable volume in the imaging cartridge by a percentage ranging from 0 to 100%. The accuracy of the remaining consumable volume is 1%. For an imaging cartridge having a number of printable page of 800, when the imaging device displays that only one cell in the progress bar indicating the remaining consumable volume information remains (corresponding to 5% of the full consumable volume), the number of remaining printable pages is 40. It may be timely for the user to purchase a new consumable cartridge for replacement at that moment. For an imaging cartridge having a number of printable pages of 200, when the imaging device displays that only one cell in the progress bar indicating the remaining consumable volume information remains (corresponding to 5% of the full consumable volume), the number of remaining printable pages is only 10, A printing task printing a large number of pages may exhaust the consumable. So the misjudgment on the number of remaining printable pages by the user may lead to the failure to have a new imaging cartridge ready timely. For an imaging cartridge having a number of printable pages of 2,000, when the imaging device displays that only one cell in the progress bar indicating the remaining consumable volume information remains (corresponding to 5% of the full consumable volume), the number of remaining printable pages is 100. That figure corresponds to 50% of consumable volume of a small volume imaging cartridge. At that moment, a reminder to the user may lead to a premature replacement of the previous imaging cartridge by the user, which may cause the waste of consumable.

During each imaging operation, the imaging device writes new consumable volume information into the imaging cartridge chip to update consumable volume information previously stored in the imaging cartridge chip. The higher accuracy the consumable volume information is, the larger the byte is. When the power supply to the imaging device is interrupted suddenly, it may be likely to occur that the consumable volume information is unable to be written into the imaging cartridge chip completely, which may cause the writing error or loss of consumable volume information.

SUMMARY

The technical problem to be solved by the present disclosure is to overcome the deficiencies of the prior art that a misjudgment is easy to make when the same standard to indicate remaining consumable volume is adopted for different imaging cartridges.

In order to solve the above problem, according to some embodiments of the present disclosure, a method of operating an imaging cartridge chip to respond to read/write consumable volume information in an imaging device is provided. The method includes the steps of: receiving and storing first consumable volume information from the imaging device; receiving second consumable volume information from the imaging device; obtaining and transmitting the first consumable volume information to the imaging device by the imaging cartridge chip when the imaging device requests reading consumable volume information stored in the imaging cartridge chip for determining a remaining consumable volume in an consumable cartridge; obtaining and transmitting the second consumable volume information to the imaging device by the imaging cartridge chip when the imaging device requests reading consumable volume information stored in the imaging cartridge chip for indicating a remaining consumable volume in the consumable cartridge. The second consumable volume information is less accurate than the first consumable volume information.

Preferably, obtaining and transmitting the second consumable volume information to the imaging device by the imaging cartridge chip includes: generating the second consumable volume information based on the first consumable volume information and an algorithm between the first consumable volume information and the second consumable volume information; and transmitting the generated second consumable volume information to the imaging device.

Preferably, the method further includes one of: storing the second consumable volume information received from the imaging device; or obtaining the second consumable volume information based on the first consumable volume information received from the imaging device and a algorithm between the first consumable volume information, and storing the obtained second consumable volume information.

Preferably, storing second consumable volume information includes one of: after the second consumable volume information is received from the imaging device, updating locally stored second consumable volume information with the received second consumable volume information; or after the second consumable volume information is generated based on the first consumable volume information received from the imaging device and an algorithm between the first consumable volume information and the second consumable volume information, updating locally stored second consumable volume information with the generated second consumable volume information. Obtaining the second consumable volume information and transmitting the second consumable volume information to the imaging device by the imaging cartridge chip include: reading the locally stored second consumable volume information and transmitting the locally stored second consumable volume information to the imaging device by the imaging cartridge chip.

Preferably, storing the second consumable volume information includes: determining a new storage section for the second consumable volume information and storing the received second consumable volume information or the generated second consumable volume information in the new storage section.

Preferably, the method includes: marking the second consumable volume information stored in the new storage section as valid after storing the received second consumable volume information in the new storage section. Transmitting the second consumable volume information to the imaging device by the imaging cartridge chip includes: reading the stored second consumable volume information marked as valid and transmitting the stored second consumable volume information marked as valid to the imaging device.

Preferably, obtaining the second consumable volume information by the imaging cartridge chip and transmitting the second consumable volume information to the imaging device by the imaging cartridge chip include: selecting second consumable volume information indicating a least remaining consumable volume as valid second consumable volume information among all second consumable volume information stored in the imaging cartridge chip; and transmitting the valid second consumable volume information to the imaging device.

Preferably, the algorithm between the second consumable volume information and the first consumable volume information includes that the second consumable volume information includes N states, N being equal to or greater than 2. Each state of the N states has a different data content of the second consumable volume information. The first consumable volume information that indicates a full consumable volume corresponds to N equal parts. The N equal parts corresponding to the N states of the second consumable volume information. The second consumable volume information changes as the remaining consumable volume indicated by the first consumable volume information decreases by one equal part of the N equal parts.

According to some embodiments of the present disclosure, an imaging cartridge chip is provided. The imaging cartridge chip includes a receiving unit configured to receive first consumable volume information and second consumable volume information from an imaging device; a storage unit configured to store the first consumable volume information; an consumable volume scale unit configured to provide the second consumable volume information. The first consumable volume information is more accurate than the second consumable volume information. The second consumable volume information includes N states. N is equal to or greater than 2. Each state of the N states has a different data content of the second consumable volume information. The first consumable volume information that indicates a full consumable volume corresponds to N equal parts. The N equal parts corresponding to the N states of the second consumable volume information. The second consumable volume information changes as the remaining consumable volume indicated by the first consumable volume information decreases by one equal part of the N equal parts.

Preferably, the consumable volume scale unit is configured to generate the second consumable volume information based on the first consumable volume information stored in the storage unit and an algorithm between the first consumable volume information and the second consumable volume information.

Preferably, the consumable volume scale unit is configured to store the second consumable volume information. When the first consumable volume indicates that the remaining consumable volume decreases by one equal part of the N equal parts: second consumable volume information previously stored in the consumable volume scale unit is updated with new second consumable volume information, the new second consumable volume information having a state different from a state of the previous second consumable volume information; or the new second consumable volume information is written into a free storage section of the consumable volume scale unit, the new second consumable volume information having a state different from the state of the previous second consumable volume information.

Compared with the prior art, according to some embodiments of the present disclosure, the present disclosure may overcome the deficiencies existing in the prior art that may make a misjudgment is made easily when the same standard to indicate the remaining consumable volume is adopted for different imaging cartridges. The need for the imaging device to determine the remaining consumable volume accurately may be satisfied. At the same time, the user may be properly reminded that the consumable cartridge needs to be replaced or the ink/toner needs to be added, without causing the user to misjudge on the number of remaining printable pages.

Other features and advantages of the present disclosure will be outlined in the following description. Moreover, parts of the features and advantages of the present disclosure will be apparent from the following description or may be understood by reading the technical solution of the present disclosure. The purpose and advantages of the present disclosure can be achieved and obtained through the structures and/or flowcharts as specifically indicated in the description, claims, and drawings.

BRIEF DESCRIPTION OF THE DRAWINGS

The drawings are provided for further understanding of the technical solution of the present disclosure or the prior art and constitute part of the description. They serve to explain the present disclosure in conjunction with the embodiments, rather than to limit the present disclosure in any manner.

FIG. 5 is a schematic diagram illustrating consumable levels according to some embodiments of the present disclosure;

FIG. 6 and FIG. 7 are schematic diagram illustrating storing the second consumable volume information in the second consumable volume information storage unit according to some embodiments of the present disclosure; and FIG. 8 is a schematic diagram illustrating an algorithm between the first consumable volume information and the second consumable volume information according to some embodiments of the present disclosure.

DETAILED DESCRIPTION

The present disclosure will now be described in detail below in conjunction with the drawings and the embodiments, which are provided as illustrative examples, so as to enable those skilled in the art to fully understand and practice the present disclosure. It is to be understood that the embodiments of the present disclosure and features of the embodiments of the present disclosure can be combined with each other as long as no conflict occurs, and a technical solution formed in this way falls within the scope of the present disclosure.

In addition, the steps shown in the flowcharts of the figures may be performed in a computer system such as a set of computer-executable instructions. Although orders are shown in the flowchart, in some situation, the steps shown or described may be performed in any order different from that described herein.

Figure 1:
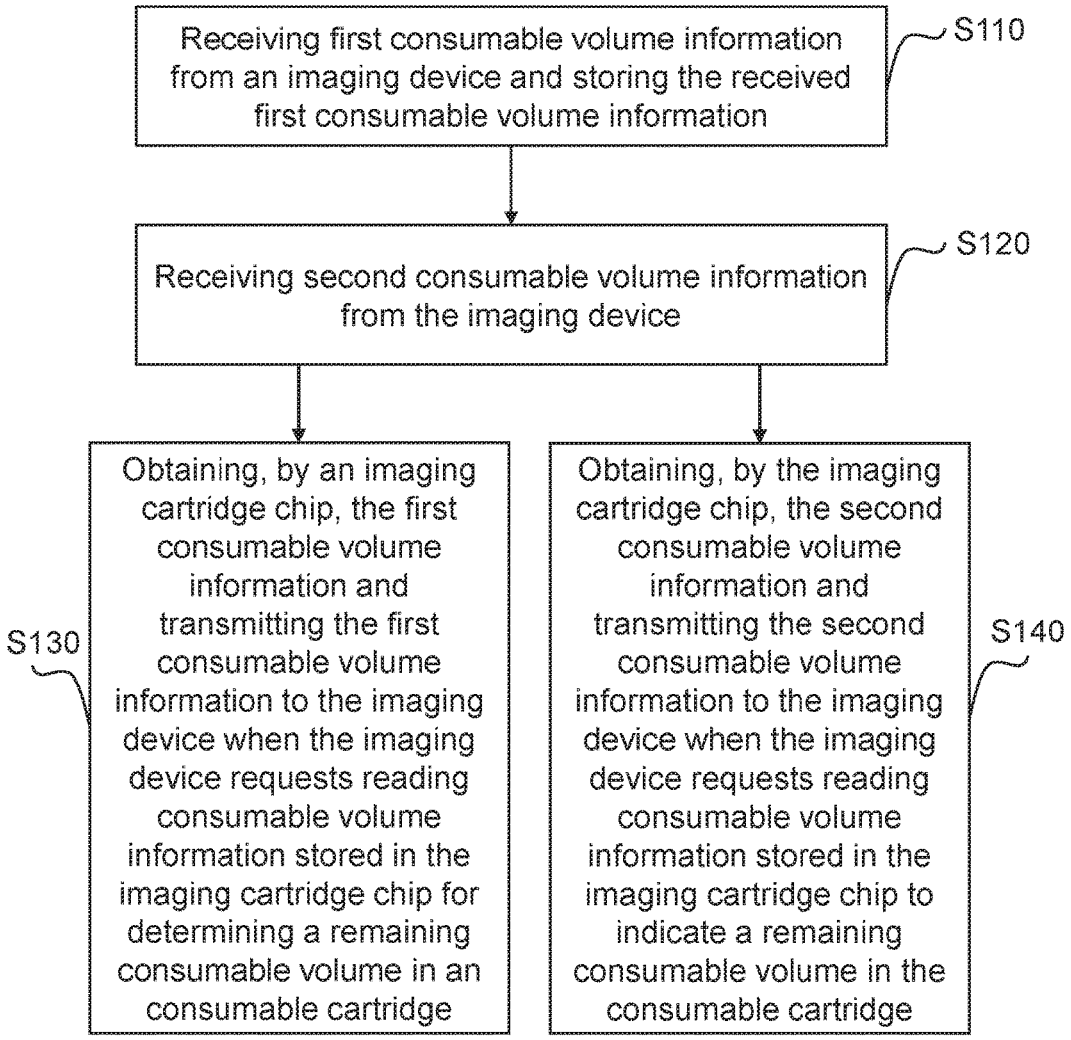
FIG. 1 is a flowchart of an exemplary process for storing consumable volume information according to some embodiments of the present disclosure.

As shown in FIG. 1, according to some embodiments of the present disclosure, the method of operating an imaging cartridge chip to respond to read/write consumable volume information in an imaging device may include the following steps.

In step S110, the imaging cartridge chip may receive first consumable volume information from the imaging device and store the received first consumable volume information.

In step S120, the imaging cartridge chip may receive second consumable volume information from the imaging device.

Both the first consumable volume information and the second volume information may be used to indicate the remaining consumable volume in an imaging cartridge. The currently remaining consumable volume in the consumable cartridge indicated by the second consumable volume information is less accurate than the currently remaining consumable volume in the consumable cartridge indicated by the first consumable volume information. When the imaging device requires more accurate information of the remaining consumable volume to perform printing control, the imaging cartridge chip may return the first consumable volume information based on the request of the imaging device. When the imaging device requires less accurate information of the remaining consumable volume to timely remind the user of the number of printable pages with the currently remaining consumable volume, the imaging cartridge chip may return the second consumable volume information based on the request of the imaging device.

In step S130, when the imaging cartridge chip receives a first reading request from the imaging device for reading consumable volume information stored in the imaging cartridge chip for determining the remaining consumable volume in the consumable cartridge, the imaging cartridge chip read the first consumable volume information based on the first reading request and transmit the first consumable volume information to the imaging device.

In step S140, when the imaging cartridge chip receives a second reading request from the imaging device for reading consumable volume information stored in the imaging cartridge chip to indicate the remaining consumable volume in the consumable cartridge, the imaging cartridge chip may obtain the second consumable volume information based on the second reading request and transmit the second consumable volume information to the imaging device.

According to some embodiments of the present disclosure, the second consumable volume information may indicate the number of printable pages with the current remaining consumable volume in the imaging cartridge. The number of printable pages indicated by the second consumable volume information may be an estimated number based on the currently remaining consumable volume in the imaging cartridge, as long as the estimated number can indicate the number of pages that can be approximately printed using the remaining consumable volume in the imaging cartridge to some extent. The purpose is to timely notify the user that the consumable cartridge needs to be replaced or the consumable/toner needs to be added as the printable pages with the currently remaining consumable volume are relatively few.

According to some embodiments of the present disclosure, the imaging cartridge chip may or may not store the second consumable volume information.

According to some embodiments of the present disclosure, in the case that the imaging cartridge chip does not store the second consumable volume information and receives the second reading request from the imaging device, the imaging cartridge chip may obtain the second consumable volume information based on the second reading request and transmit the second consumable volume information to the imaging device. The imaging cartridge chip may obtain the second consumable volume information based on the stored first consumable volume information and an algorithm between the first consumable volume information and the second consumable volume information and transmit the second consumable volume information to the imaging device.

According to some embodiments of the present disclosure, in the case that the imaging cartridge chip stores the second consumable volume information, the imaging cartridge chip may store different sets of second consumable volume information.

The imaging cartridge chip may store the second consumable volume information received from the imaging device directly. Additionally or alternatively, the imaging cartridge chip may obtain the second consumable volume information based on the first consumable volume information from the imaging device and the algorithm between the first consumable volume information and store the second consumable volume information.

According to some embodiments of the present disclosure, different storage modes may be adopted when the imaging cartridge chip stores the second consumable volume information.

The first storage mode is updating storage. Specifically, after receiving the second consumable volume information from the imaging device, the imaging cartridge chip may update locally stored second consumable volume information with the received second consumable volume information. That is, the imaging cartridge chip may erase second consumable volume information previously stored in a storage unit of the imaging cartridge chip and may write the received second consumable volume information into the storage section storing the previous second consumable volume information. Or maybe, after obtaining the second consumable volume information based on the first consumable volume information received from the imaging device and the algorithm between the first consumable volume information and the second consumable volume information, the imaging cartridge chip may update locally stored second consumable volume information with the obtained second consumable volume information. That is, the imaging cartridge chip may erase second consumable volume information previously stored in the storage unit of the imaging cartridge chip and write the obtained second consumable volume information into the storage section storing the previous second consumable volume information.

The second storage mode is that the imaging cartridge chip may determine a new storage section and store the second consumable volume information into the new storage section. The new storage section may be different from a storage section storing previous second consumable volume information. Specifically, after receiving the second consumable volume information from the imaging device, the imaging cartridge chip may determine a new storage section for the received second consumable volume information and store the received second consumable volume information into the new storage section. In other words, the imaging cartridge chip may reserve the previous second consumable volume information stored in the storage unit of the imaging cartridge chip and write the received consumable volume information into a new storage section different from a storage section storing the previous second consumable volume information. Or maybe, After obtaining the second consumable volume information based on the first consumable volume information received from the imaging device and the algorithm between the first consumable volume information and the second consumable volume information, the imaging cartridge chip may determine a new storage section for the obtained second consumable volume information and store the obtained second consumable volume information into the new storage section. In other words, the imaging cartridge chip may reserve the previous second consumable volume information stored in the storage unit of the imaging cartridge chip and write the obtained consumable volume information into the new storage section different from the storage section storing the previous second consumable volume information.

Thus, the imaging cartridge chip may store multiple sets of second consumable volume information. In order to ensure transmitting valid second consumable volume information to the imaging device, after storing the received second consumable volume information into the new storage section, the imaging cartridge chip may mark the received second consumable volume information stored in the new storage section as valid. The imaging cartridge chip may select the second consumable volume information indicating the least remaining consumable volume as the valid second consumable volume information among all sets of second consumable volume information stored in the imaging cartridge chip. The imaging cartridge chip may transmit the valid second consumable volume information to the imaging device. Compared with the method that the imaging cartridge chip transmits the most recently stored second consumable volume information to the imaging device, the method that the imaging cartridge chip transmits the valid second consumable volume to the imaging device may avoid the error in the second consumable volume information as much as possible and reduce the probability of incorrect indication of the number of printable pages.

For the second storage mode, the imaging cartridge chip may determine a new storage section for the received second consumable volume information or the obtained second consumable volume information in advance. After receiving or generating second consumable volume information, the imaging cartridge chip may store the received second consumable volume information or the obtained second consumable volume information into the new storage section that has been determined in advance.

For the first storage mode, the imaging cartridge chip may read the locally stored second consumable volume information and transmit the updated second consumable volume information to the imaging device when the imaging cartridge chip needs to obtain the second consumable volume information and transmit the second consumable volume information to the imaging device.

For the second storage mode, the imaging cartridge chip may read the locally stored second consumable volume information that is marked as valid and transmit the valid second consumable volume information to the imaging device when the imaging cartridge chip needs to obtain the second consumable volume information and transmit the second consumable volume information to the imaging device.

According to some embodiments of the present disclosure, the second consumable volume information may include N states. N is a natural number that is equal to or greater than 2. Each state of the N states may have a different data content of the second consumable volume information. When indicating a full consumable volume, the first consumable volume information may correspond to N equal parts. The N equal parts may correspond to the N states of the second consumable volume information. In other words, when the consumable cartridge is full, the remaining consumable volume indicated by the first consumable volume information may be divided into N equal parts. The remaining consumable volume indicated by the first consumable volume information decreases by 1/N of the full consumable volume (one equal part of the N equal parts) may correspond to an consumable level. Each consumable level of the first consumable volume information may correspond to one state of the N states of the second consumable volume information. The second consumable volume information changes accordingly when the remaining consumable volume indicated by the first consumable volume information decreases by one equal part of the N equal parts. Thus, there is an algorithm between the first consumable volume information and the second consumable volume information.

When applying embodiments of the present disclosure, the imaging device may continuously display the second consumable volume information. The second consumable volume information may be displayed in the form of, for example, a progress bar, a number of printable pages, or a percentage. The displayed second consumable volume information may change accordingly when the remaining consumable volume indicated by the first consumable volume information decreases by one equal part of the N equal parts. A user of the imaging device may know a ballpark figure of remaining printable pages with the remaining consumable volume in the imaging cartridge intuitively.

Alternatively, when the remaining consumable volume indicated by the second consumable volume information is equal to or less than a predetermined threshold, the imaging device may notify the user the remaining consumable volume in the consumable cartridge based on the second consumable volume information. The notification may be given in various ways, for example, sound, light, etc. The various ways may include, for example, displaying the second consumable volume information, activate an indicator light based on the second consumable volume information, causing the indicator light to blink based on the second consumable volume information, generating an audio alert based on the second consumable volume information, etc. The various ways may draw the user's attention and remind the user of replacing the imaging cartridge in time. Apparently, the above mentioned ways can be used alone, or used in combination of two or more thereof.

According to some embodiments of the present disclosure, the imaging cartridge chip store two sets of consumable volume information that have different levels of accuracy for satisfying different needs of the imaging device. Different numbers of consumable levels for the second consumable volume information may be set according to the number of printable pages for different types of imaging cartridges. Therefore, the need of the imaging device to determine the remaining consumable volume accurately may be satisfied. The misjudgment by the user on the number of printable pages may also be avoided.

Figure 2:
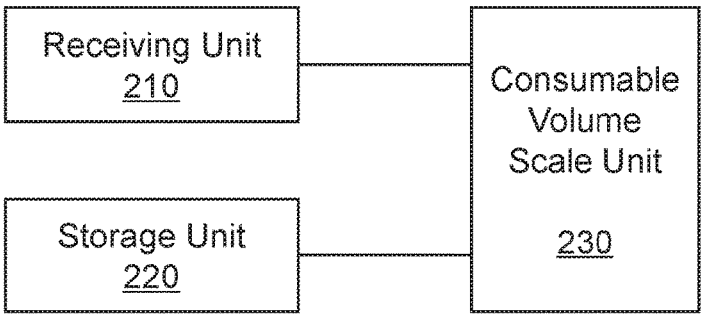
FIG. 2 is a schematic diagram illustrating an imaging cartridge chip according to some embodiments of the present disclosure.

As shown in FIG. 2, according to some embodiments of the present disclosure, the chip of the imaging cartridge may include a receiving unit 210, a storage unit 220, and an consumable volume scale unit 230.

The receiving unit 220 may be configured to receive the first consumable volume information and the second consumable volume information from the imaging device.

The storage unit 220 may be in communication with the receiving unit 220 and may be configured to store the first consumable volume information.

The consumable volume scale unit 230 may be in communication with the receiving unit 210 and the storage unit 220. The consumable volume scale unit 230 may be configured to provide the second consumable volume information.

The second consumable volume information may be less accurate than the first consumable volume information. The second consumable volume information may include N states, where N is equal to or greater than 2. Each state of the N states may have a different data content of the second consumable volume information. The first consumable volume information may correspond to N equal parts when the first consumable volume information indicates a full consumable volume. The N equal parts may correspond to the N states of the second consumable volume information. In other words, the remaining consumable volume indicated by the first consumable volume information may be divided into N equal parts when the consumable cartridge is full of consumable, the remaining consumable volume indicated by the first consumable volume information decreases by 1/N of the full consumable volume (one equal part of the N equal parts) may correspond to an consumable level. Each consumable level of the first consumable volume information may correspond to one state of the N states of the second consumable volume information. The second consumable volume information may change accordingly when the remaining consumable volume indicated by the first consumable volume information decrease by one equal part of the N equal parts.

According to some embodiments of the present disclosure, the consumable volume scale unit 230 may be configured to generate the second consumable volume information based on the first consumable volume information stored in the storage unit 220 and the algorithm between the first consumable volume information and the second consumable volume information.

According to some embodiments of the present disclosure, the consumable volume scale unit 230 may be configured to be designated as the second consumable volume information storage unit for storing the second consumable volume information. When the remaining consumable volume indicated by the first consumable volume information decreases by one equal part of the N equal parts, the second consumable volume information previously stored in the consumable volume scale unit may be updated with new second consumable volume information. The new second consumable volume information may have a state different from the state of the previous second consumable volume information; or the new second consumable volume information may be written into an unoccupied storage section of the consumable volume storage unit, wherein the new second consumable volume information may have a state different from the state of the previous second consumable volume information.

According to some embodiments of the present disclosure, for an understanding of the imaging cartridge chip in the consumable cartridge as shown in FIG. 2, please see the description of the methods of operating the imaging cartridge chip to respond to read/write consumable volume information in the imaging device in connection with FIG. 1.

Figure 3:
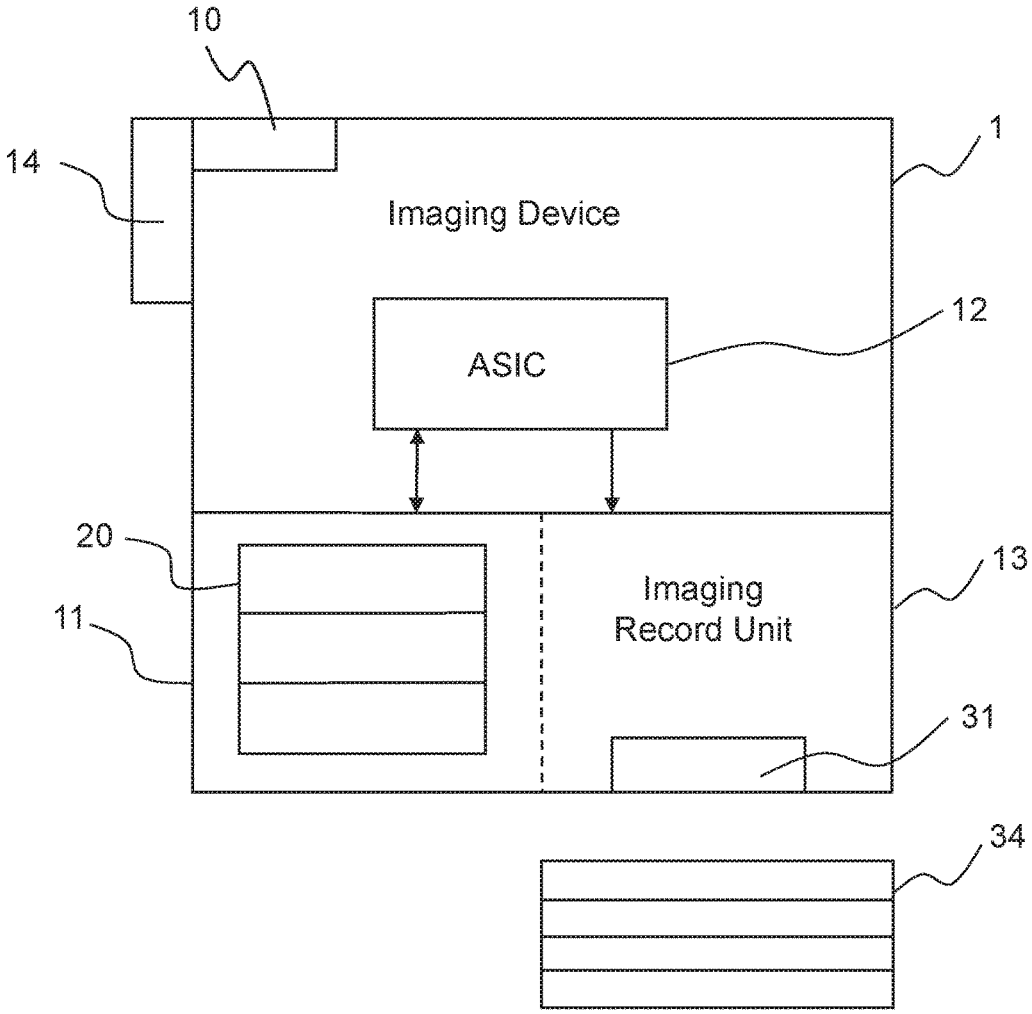
FIG. 3 is a schematic diagram illustrating an imaging device according to some embodiments of the present disclosure.

FIG. 3 is a schematic diagram illustrating imaging device according to some embodiments of the present disclosure. Imaging device 1 may include a user port 10, an installation location 11 of the imaging cartridge, an Application-Specific Integrated Circuit (ASIC) 12, an imaging record unit 13, and a display interface 14. The user port 10 may be configured to connect to the peripheral device(s), such as a computer, a mobile phone, a video camera, etc. It may help the imaging device to receive user instructions from the peripheral device(s). A plurality of detachable imaging cartridges 20 may be installed in the installation location 11. Different imaging cartridges 20 may contain imaging materials (consumable as mentioned above) of different colors or types and provide the imaging materials to the imaging record unit 13. The display interface 14 may be a display mounted on the imaging device. According to some embodiments of the present disclosure, the imaging device 1 may display a user interface to the user during imaging operations through a peripheral display. The imaging device 1 may include, for example, an ink jet imaging device and/or a copier, or an electrophotographic imaging device and/or a copier.

According to the above embodiments of the imaging device 1, the imaging record unit 13 may be, for example, an ink jet printhead unit or an electrophotographic printing unit. And the imaging recording unit 13 may include an imaging head 31 for forming an image on a substrate 34, such as a sheet of print media or a photo-sensitive member. For the sake of convenience, each type of substrates 34 will be represented by the reference number 34, for example, print media 34. The imaging cartridge 20 may be, for example, an ink supply tank, an ink jet printhead cartridge (PH), a toner tank, or an electrophotographic process (EP) cartridge, etc. The imaging device 1 may use ink contained in the imaging cartridge 20 to form an image on the print media 34. The print media 34 may be, for example, a paper sheet, fabric sheet, or transparency.

Those skilled in the art will recognize that the imaging record unit 13 and the imaging cartridge 20 may be formed as individual discrete units or may be combined in an integrated unit. The imaging cartridge 20 may be installed detachably in the imaging device 1. For example, in ink jet technology, the integrated unit may be an ink jet printhead cartridge PH of an ink reservoir and an ink jet printhead in the form of a single consumable. Thus, for the sake of convenience, the term "imaging cartridge" is used to include either the discrete configuration or the integrated configuration described above, and is an example of a disposable. Preferably, a chip for storing information relating to the imaging cartridge 20 may be mounted on the outer wall of the imaging cartridge 20. The imaging cartridge chip may communicate with the imaging device through a bus. In the consumable jet printhead cartridge PH, the imaging cartridge chip may be part of the printhead.

Figure 4:
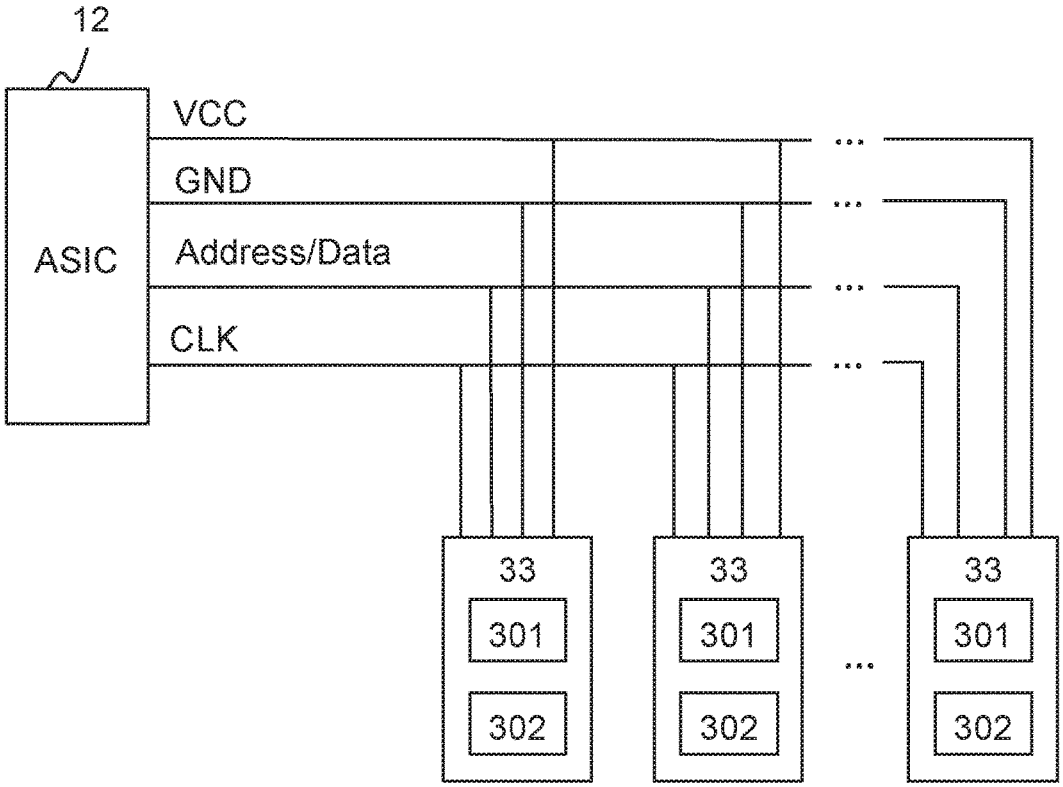
FIG. 4 is a schematic diagram illustrating the connection between an imaging device and a imaging cartridge chip according to some embodiments of the present disclosure.

As shown in FIG. 4, the Application-Specific Integrated Circuit (ASIC) 12 of the imaging device 1 may communicate with the imaging cartridge chip 33 through a bus. The bus may include a power supply line VCC, a clock line CLK, a ground line GND, and an address data line Address/Data, etc. The imaging cartridge chip 33 may be in communication with the bus, so as to receive power supply from the imaging device and to perform various signal transmissions with the imaging device.

The imaging cartridge chip 33 may include a control unit 301 and a storage unit 302. The control unit 301 may receive signals from the Application-Specific Integrated Circuit (ASIC) 12 and perform corresponding operations based on the received signals. After the end of an imaging operation or during the imaging operation, the imaging device may detect or determine the remaining consumable volume, i.e., the first consumable volume information, in the consumable cartridge. The imaging device may write the first consumable volume information into the storage unit 302 of the imaging cartridge chip.

According to some embodiments of the present disclosure, the imaging device may also write the second consumable volume information into the imaging cartridge chip. Both the first consumable volume information and the second volume information are used to indicate the remaining consumable volume in the imaging cartridge. The currently remaining consumable volume in the consumable cartridge indicated by the second consumable volume information is less accurate than the currently remaining consumable volume in the consumable cartridge indicated by the first consumable volume information to display the number of printable pages with the imaging cartridge to the user through the imaging device or the peripheral device connected to the imaging device. The second consumable volume information may be an consumable level based on the dividing of the full consumable volume in the imaging cartridge.

According to some embodiments of the present disclosure, the second consumable volume information may include a plurality of states. Each state of the second consumable volume information may have different data content. If the full consumable volume in the imaging cartridge is divided into N equal parts, the second consumable volume information may be presented as N states. N is a positive integer that is equal to or greater than 2. Each state of the N states may correspond to an consumable level to indicate the remaining consumable volume in the imaging cartridge or the number of printable pages with the remaining consumable volume. So the user may be reminded of the number of printable pages with the remaining consumable volume in the imaging cartridge in a relatively intuitive way.

The currently remaining consumable volume in the consumable cartridge indicated by the second consumable volume information is less accurate than the currently remaining consumable volume in the consumable cartridge indicated by the first consumable volume information. So the second consumable volume information may changes less frequently than the first consumable volume information. Moreover, when the remaining consumable volume in the imaging cartridge is relatively large, usually the user may not be concerned with the remaining consumable volume. With the gradual decrease of the remaining consumable volume, the user will be more and more concerned about the remaining consumable volume. Especially, the user may be more and more concerned about the number of printable pages with the remaining consumable volume to be ready to replace the image cartridge that is hard to continue printing anymore.

For the scenarios in which the full consumable volume in the imaging cartridge is divided into N consumable levels, $$\text{accuracy of the second consumable volume information} = \text{accuracy of the first consumable volume information} \times \frac{\text{consumable volume indicated by the first consumable volume information when the consumable is full}}{N}.$$

When the consumable level of the remaining consumable volume in the imaging cartridge changes, the second consumable volume information may be updated to indicate the number of printable pages with the latest remaining consumable volume.

For example, the imaging device may store the first consumable volume information as a percentage ranging from 0 to 100%. The full consumable volume indicated by the first consumable volume information may be divided into eight consumable levels. The second consumable volume information may be a binary number of four bytes. The consumable volume indicated by the first consumable volume information may be divided into eight consumable levels. When the first consumable volume information decreases by 12.5%, the imaging device may write second consumable volume information having a new state into the imaging cartridge chip. As shown in FIG. 5, when the consumable volume indicated by the first consumable volume information is 100%, the corresponding data content of second consumable volume information is 0000. When the consumable volume indicated by the first consumable volume information is 87.5%, the corresponding data content of second consumable volume information is 0001. When the consumable volume indicated by the first consumable volume information is 75%, the corresponding data content of second consumable volume information is 0010. When the consumable volume indicated by the first consumable volume information is 62.5%, the corresponding data content of second consumable volume information is 0100. When the consumable volume indicated by the first consumable volume information is 50%, the corresponding data content of second consumable volume information is 0101. When the consumable volume indicated by the first consumable volume information is 37.5%, the corresponding data content of second consumable volume information is 1101. When the consumable volume indicated by the first consumable volume information is 25%, the corresponding data content of second consumable volume information is 1000. When the consumable volume indicated by the first consumable volume information is 12.5%, the corresponding data content of second consumable volume information is 1001. When the consumable volume indicated by the first consumable volume information is 0%, the corresponding data content of second consumable volume information is 0011.

The above embodiments are merely for illustrative purposes. The number of consumable levels in the actual application, the number of bits of the second consumable volume information, and the rule of the data change are not limited to the present disclosure, as long as the data of an consumable level indicated by the second consumable volume information is different from each other.

After an imaging operation ends or the power supply to the imaging device is interrupted suddenly, the imaging device may speculate the second consumable volume information based on the first consumable volume information. After detecting or determining the first consumable volume information, the imaging device may determine whether the consumable level of the remaining consumable volume indicated by the first consumable volume information has changed. If the answer is "yes," the imaging device may obtain the second consumable volume information based on the remaining consumable volume indicated by the first consumable volume information, and write the first consumable volume information and the second consumable volume information into the storage unit 302 of the imaging cartridge chip. If the imaging device determines that the consumable level of the remaining consumable volume indicated by the first consumable volume information has not changed, (i.e., the second consumable volume information does not change), the imaging device may write the first consumable volume information into the storage unit 302 of the imaging cartridge chip.

After the power applies to the imaging cartridge chip, the imaging device may read the first consumable volume information stored in the imaging cartridge chip for determining the remaining consumable volume in the imaging cartridge accurately. The imaging device may read the second consumable volume information for displaying the remaining consumable volume to the user in a relatively intuitive way, for example, a progress bar or a progress percentage, to remind the user of replacing imaging cartridge timely when the remaining consumable volume is relatively few.

In respond to operations of the imaging device, the storage unit 302 of the imaging cartridge chip 33 may include a second consumable volume storage unit for storing the second consumable volume information. Specifically, when the imaging cartridge chip receives the second consumable volume information from the imaging device, the imaging cartridge chip may erase the second consumable volume information previously stored in the second consumable volume storage unit and write newly received second consumable volume information into the second consumable volume storage unit. When the imaging cartridge chip receives a request for reading second consumable volume information from the imaging device, the imaging cartridge chip may transmit the newly received second consumable volume information stored in the second consumable volume information storage unit to the imaging device.

Alternatively, the second consumable volume information storage unit may include a data flag bit. When the imaging cartridge chip receives second consumable volume information from the imaging device, the control unit 301 may not erase previous second consumable volume information stored in the second consumable volume information storage unit. The control unit 301 may write new received second consumable volume information into a new storage section of the second consumable volume information storage unit, and then mark the new received second consumable volume information as the current second consumable volume information by the flag. When the imaging cartridge chip receives a request for reading the second consumable volume information from the imaging device, the control unit 301 may transmit the second consumable volume information recently stored in the second consumable volume information storage unit to the imaging device based on the flag. In this situation, the imaging cartridge chip may not have to erase previous data when writing second consumable volume information every time. Thus, the speed of storing the second consumable volume information may be improved.

Alternatively, in order to avoid the error of the second consumable volume information as much as possible and to reduce the probability of the error in indicating the number of printable pages, the control unit 301 may not erase the previously or recently stored second consumable volume information stored in the second consumable volume information storage unit, which differs from the method that the latest second consumable volume information stored in the second consumable volume information storage unit is marked as the current second consumable volume information. The control unit 301 may write the newly received second consumable volume information into a new storage section of the second consumable volume information storage unit. When the imaging cartridge chip receives a request for reading the second consumable volume information from the imaging device, the imaging cartridge chip may select, among all sets of the second consumable volume information stored in the second consumable volume information storage unit, a set of second consumable volume information indicating the least remaining consumable volume as the valid second consumable volume information. The imaging cartridge chip may transmit the valid second consumable volume information to the imaging device. Specifically, the method for selecting a set of second consumable volume information indicating a least remaining consumable volume may include performing a logic operation (e.g., logic AND operation) on all sets of the second consumable volume information stored in the second consumable volume information storage unit and outputting the selected set of second consumable volume information. FIG. 6 and FIG. 7 are schematic diagrams illustrating storage of the second consumable volume information in the second consumable volume information storage unit. The second consumable volume information storage unit may include N states of second consumable volume information, a1, a2, a3, . . . , aN. When the imaging cartridge chip receives second consumable volume information b from the imaging device (as shown in FIG. 6), the imaging cartridge chip control unit 301 may compare the second consumable volume information b with multiple pieces of second consumable volume information, a1, a2, a3, . . . , aN, stored in the second consumable volume information storage unit. The imaging cartridge chip control unit 301 may then change a data flag bit corresponding to the second consumable volume information a3 to 1 when the received second consumable volume information b is identical to the stored second consumable volume information a3. The imaging cartridge chip control unit 301 may change data flag bits corresponding to other pieces of second consumable volume information, a1, a2, a4, . . . , aN, to 0 (as shown in FIG. 7). Then the stored second consumable volume information a3 may be marked as the current second consumable volume information. When the imaging cartridge chip receives a request for reading second consumable volume information from the imaging device, the imaging cartridge chip control unit 301 may transmit the second consumable volume information corresponding to the data flag bit "1" to the imaging device. The above embodiments illustrate the scenario in which the second consumable volume information corresponding to the data flag bit "1" is determined as the current second volume information. In practice, the second consumable volume information corresponding to the data flag bit "0" may also be determined as the current second consumable volume information. The description of that scenario will not be repeated herein.

According to the above embodiments, the second consumable volume information is written into the imaging cartridge chip after being detected or determined by the imaging device. According to another embodiment of the present disclosure, the second consumable volume information may be generated by operation of the imaging cartridge chip itself, and may not need to be written in by the imaging device. As each consumable level corresponds to a different state of second consumable volume information and the first consumable volume information in the same consumable level corresponds to the same state of second consumable volume information, the Imaging cartridge chip may determine the second consumable volume information based on the first consumable volume information stored in the storage. The imaging cartridge chip may also obtain the first consumable volume information based on the second consumable volume information and the predetermined algorithm between the first consumable volume information and the second consumable volume information (e.g., a mapping table).

During a process in which the imaging cartridge chip reads the second consumable volume information in response to the imaging device, the imaging cartridge chip control unit may read the first consumable volume information stored in the storage. The imaging cartridge chip control unit may then generate second consumable volume information based on the first consumable volume information and an algorithm between the first consumable volume information and the second consumable volume information and transmit the second consumable volume information to the imaging device.

According to some embodiments of the present disclosure, the imaging cartridge chip may determine the second consumable volume information by applying a preset algorithm on the first consumable volume information. When receiving a request for reading the second consumable volume information from the imaging device, the imaging cartridge chip may read the first consumable volume information stored in the storage and initiate the preset algorithm to determine the second consumable volume information. The imaging cartridge chip may store a mapping table indicating the algorithm between first consumable volume information and second consumable volume information. When receiving a request for reading second consumable volume information from the imaging device, the imaging cartridge chip may read the first consumable volume information stored in the storage and obtain the corresponding second consumable volume information by searching in the mapping table.

For a further understanding of the embodiments of the present disclosure, FIG. 8 illustrates an algorithm between the first consumable volume information and the second consumable volume information. When receiving a request for reading the second consumable volume information from the imaging device, the imaging cartridge chip may first read the first consumable volume information 10011111 stored in the storage and obtain the second consumable volume information 1001 correspond to the first consumable volume information 10011111 by searching in the mapping table. Then the control unit may transmit the second consumable volume information 1001 to the imaging device.

The above embodiments are merely for illustrative purposes. The numbers of bits of the first consumable volume information and second consumable volume information, and the algorithm between the first consumable volume information and the second consumable volume information are not limited to the present disclosure.

According to the imaging device and the imaging cartridge chip of the present disclosure, the imaging cartridge chip stores the first consumable volume information having a higher level of accuracy. Thus, the imaging device may determine the remaining consumable volume precisely and ensure the imaging cartridge does not have a relatively large volume of remaining consumable to be wasted when the imaging cartridge chip is "locked." Meanwhile, the imaging cartridge chip may also store the second consumable volume information that has a lower level of accuracy, the imaging device or the peripheral equipment connected to the imaging device may display the remaining consumable volume indicated by the second consumable volume information. Thus, it is possible to set the second consumable volume information having different numbers of consumable levels based on the number of printable pages, avoiding the user's misjudgment on the number of remaining printable pages.

For example, for an imaging cartridge that has 200 printable pages, 10 consumable levels for second consumable volume information may be set. In other words, N is 10. For an imaging cartridge that has 500 printable pages, 50 consumable levels for second consumable volume information may be set. In other words, N is 50. When the imaging device displays only one cell of the progress bar indicating the information of the remaining consumable volume, there may be 20 printable pages in both scenarios, allowing the user to purchase a new imaging cartridge for replacement timely.

In addition, the imaging cartridge chip may store two kinds of consumable volume information with different accuracies. The first consumable volume information with a higher level of accuracy may change after each printing operation. The second consumable volume information with a lower level of accuracy may change only when the consumable level changes. The first consumable volume information may be estimated based on the second consumable volume information when the power supply is interrupted suddenly and the first consumable volume information is written incorrectly or lost. Similarly, if the second consumable volume information is written incorrectly or lost, the second consumable volume information may also be estimated based on the first consumable volume information. The two kinds of consumable volume information may serve as backup and verification to each other.

Those skilled in the art should understand that the various components of the imaging cartridge chip provided and steps in the method in the embodiments of the present disclosure described above may be integrated into a single computing device or distributed in a network including multiple computing devices. Optionally, they may be implemented by executable program codes of computing devices. Thus they may be stored in the storage device and executed by the computing device, or made into an individual integrated circuit module respectively, or multiple modules or steps thereof may be implemented as a single integrated circuit module. The present disclosure may not be limited to any particular combination of hardware and software.

While various embodiments of the present disclosure have been described and illustrated above, the description is only embodiments for purposes of illustration of the present disclosure and is not intended to limit the present disclosure. Without departing from the spirit and scope of the present disclosure, those skilled in the art may make various modifications and variations to forms or details of the embodiments of the present disclosure. However, the scope of the present disclosure shall be defined by the appended claims.

We claim:

1. A method of operating an imaging cartridge chip to respond to read/write consumable volume information of a consumable cartridge in an imaging device, the method comprising:

receiving, from the imaging device, first consumable volume information and storing the received first consumable volume information;

receiving, from the imaging device, second consumable volume information;

obtaining, by the imaging cartridge chip, the first consumable volume information and transmitting the first consumable volume information to the imaging device when the imaging device requests reading consumable volume information stored in the imaging cartridge chip for determining a remaining consumable volume in the consumable cartridge;

obtaining, by the imaging cartridge chip, the second consumable volume information and transmitting the second consumable volume information to the imaging device when the imaging device requests reading consumable volume information stored in the imaging cartridge chip to indicate the remaining consumable volume in the consumable cartridge, the second consumable volume information being less accurate than the first consumable volume information, wherein a bit length of the second consumable volume information is shorter than a bit length of the first consumable volume information.

2. The method of claim 1, wherein obtaining the second consumable volume information and transmitting the second consumable volume information to the imaging device includes:

generating the second consumable volume information based on the first consumable volume information and an algorithm between the first consumable volume information and the second consumable volume information and transmitting the generated second consumable volume information to the imaging device.

3. The method of claim 2, wherein the algorithm between the second consumable volume information and the first consumable volume information includes that:

the second consumable volume information includes N states, N being equal to or greater than 2, each state of the N states having a different data content of the second consumable volume information;

the first consumable volume information corresponds to N equal parts when the first consumable volume information indicates a full consumable volume, wherein the N equal parts correspond to the N states of the second consumable volume information; and the second consumable volume information changes when the remaining consumable volume indicated by the first consumable volume information decreases by one equal part of the N equal parts.

4. The method of claim 3, wherein N is less than 100.

5. The method of claim 1, further including one of:

storing the second consumable volume information received from the imaging device; or obtaining the second consumable volume information based on the first consumable volume information received from the imaging device and an algorithm between the first consumable volume information, and storing the second consumable volume information.

6. The method of claim 5, wherein storing the second consumable volume information includes one of:

after the second consumable volume information is received from the imaging device, updating locally stored second consumable volume information with the received second consumable volume information; or after the second consumable volume information is obtained based on the first consumable volume information received from the imaging device and an algorithm between the first consumable volume information and the second consumable volume information, updating locally stored second consumable volume information with the obtained second consumable volume information, wherein obtaining the second consumable volume information and transmitting the second consumable volume information to the imaging device by the imaging cartridge chip comprise: reading the updated second consumable volume information and transmitting the updated second consumable volume information to the imaging device by the imaging cartridge chip.

7. The method of claim 5, wherein storing the second consumable volume information includes:

determining a new storage section for the second consumable volume information; and storing the received second consumable volume information or the obtained second consumable volume information in the new storage section.

8. The method of claim 7, including:

marking the second consumable volume information stored in the new storage section as valid after storing the received second consumable volume information in the new storage section, wherein transmitting, by the imaging cartridge chip, the second consumable volume information to the imaging device includes: reading the stored second consumable volume information marked as valid and transmitting the stored second consumable volume information marked as valid to the imaging device.

9. The method of claim 7, wherein obtaining the second consumable volume information and transmitting the second consumable volume information to the imaging device by the imaging cartridge chip include:

selecting, among consumable volume information stored in the imaging cartridge chip, second consumable volume information indicating a least remaining consumable volume as valid second consumable volume information; and transmitting the valid second consumable volume information to the imaging device.

10. The method of claim 5, wherein the algorithm between the second consumable volume information and the first consumable volume information includes that:

the second consumable volume information includes N states, N being equal to or greater than 2, each state of the N states having a different data content of the second consumable volume information; the first consumable volume information corresponds to N equal parts when the first consumable volume information indicates a full consumable volume, wherein the N equal parts correspond to the N states of the second consumable volume information; and the second consumable volume information changes when the remaining consumable volume indicated by the first consumable volume information decreases by one equal part of the N equal parts.

11. The method of claim 1, wherein the imaging cartridge chip is mounted on the consumable cartridge.

12. An imaging cartridge chip for storing/providing consumable volume information of a consumable cartridge, comprising:

a receiving unit configured to receive first consumable volume information and second consumable volume information from an imaging device;

a storage unit configured to store the first consumable volume information; and a consumable volume scale unit configured to provide the second consumable volume information;

wherein the first consumable volume information is more accurate than the second consumable volume information, wherein a bit length of the second consumable volume information is shorter than a bit length of the first consumable volume information;

the second consumable volume information includes N states, N being equal to or greater than 2, each state of the N states having a different data content of the second consumable volume information;

the first consumable volume information corresponds to N equal parts when the first consumable volume information indicates a full consumable volume, the N equal parts correspond to the N states of the second consumable volume information; and the second consumable volume information changes as the remaining consumable volume indicated by the first consumable volume information decreases by one equal part of the N equal parts.

13. The imaging cartridge chip of claim 12, wherein the consumable volume scale unit is configured to generate the second consumable volume information based on the first consumable volume information stored in the storage unit and an algorithm between the first consumable volume information and the second consumable volume information.

14. The imaging cartridge chip of claim 12, wherein the consumable volume scale unit is configured to store the second consumable volume information, and when the remaining consumable volume decreases by one equal part of the N equal parts:

previous second consumable volume information stored in the consumable volume scale unit is updated with new second consumable volume information, wherein the new second consumable volume information has a state different from a state of the previous second consumable volume information; or the new second consumable volume information is written into an unoccupied storage section of the consumable volume scale unit, wherein the new second consumable volume information has a state different from the state of the previous second consumable volume information.

15. The imaging cartridge chip of claim 12, wherein N is less than 100.

* * * * *